US008782864B2

(12) United States Patent
Adams

(10) Patent No.: US 8,782,864 B2
(45) Date of Patent: Jul. 22, 2014

(54) SYSTEM FOR PREPARING PRE-ASSEMBLED HANGER SUPPORTS

(76) Inventor: Richard C. Adams, Roosevelt, UT (US)

( * ) Notice: Subject to any disclaimer, the term of this patent is extended or adjusted under 35 U.S.C. 154(b) by 1150 days.

(21) Appl. No.: 12/537,688

(22) Filed: Aug. 7, 2009

(65) Prior Publication Data

US 2011/0030193 A1 Feb. 10, 2011

(51) Int. Cl.
*B21D 39/00* (2006.01)
*B23P 11/00* (2006.01)

(52) U.S. Cl.
USPC ..... 29/243.56; 29/7; 29/505; 140/93 D; 140/113; 52/506.06

(58) Field of Classification Search
USPC ..... 29/7, 525.01, 525.05, 505, 796, 243.56, 29/283.5; 140/93.2, 93.6, 93 A, 93 D, 106, 140/111, 113, 114, 115, 116, 117, 123, 124, 140/149; 52/506.06, 506.08
See application file for complete search history.

(56) References Cited

U.S. PATENT DOCUMENTS

| | | | | | |
|---|---|---|---|---|---|
| 880,235 | A | * | 2/1908 | Neller | 72/388 |
| 1,752,726 | A | * | 4/1930 | Brannaka | 140/104 |
| 2,236,503 | A | * | 4/1941 | Heidrich | 140/123 |
| 2,253,983 | A | * | 8/1941 | Renier | 140/117 |
| 2,440,058 | A | * | 4/1948 | Mitchell | 140/149 |
| 2,652,074 | A | * | 9/1953 | Cantu | 140/124 |
| 2,701,589 | A | * | 2/1955 | McKinney | 140/102.5 |
| 2,857,792 | A | * | 10/1958 | McNish | 72/458 |
| 3,030,984 | A | | 5/1960 | Vogt | |
| 3,202,186 | A | * | 8/1965 | Luberacki | 140/109 |
| 3,273,605 | A | * | 9/1966 | Ferrara, Jr. | 140/93.6 |
| 3,859,770 | A | * | 1/1975 | Chambers et al. | 52/745.05 |
| 3,990,486 | A | * | 11/1976 | Quick | 140/118 |
| 4,091,845 | A | * | 5/1978 | Johnson | 140/106 |
| 4,413,660 | A | | 11/1983 | Conrad | |
| 4,416,095 | A | | 11/1983 | Truluck | |
| 4,421,145 | A | * | 12/1983 | Broberg, Jr. | 140/104 |

(Continued)

OTHER PUBLICATIONS

Photograph of early wrapping tool design, in public use since Jun. 23, 2002.

(Continued)

*Primary Examiner* — David Bryant
*Assistant Examiner* — Christopher M Koehler
(74) *Attorney, Agent, or Firm* — Thorpe North & Western LLP

(57) ABSTRACT

A system for preparing a pre-assembled hanger support. The system includes a bending tool operable to form a bight in the distal end of a structural wire, the bight having a transverse tail extending away from the shaft of the structural wire. The system also includes a wrapping tool having a drive rotor with a clip attachment interface that removably supports a hanger clip and provides selective rotation of the hanger clip and the structural wire, a wire support brace that supports the shaft of the structural wire in substantial alignment with the axis of rotation of the drive rotor, and a tail stop positioned to restrain the rotation of the transverse tail. The hanger clip is supported about the structural wire and positioned within the bight, and together the hanger clip and structural wire are installed onto the clip attachment interface, so that selective rotation of the drive rotor rotates the hanger clip and shaft of the structural wire causing the restrained transverse tail to wrap around the shaft and secure the hanger clip within an eyelet formed in the structural wire, thereby forming the pre-assembled hanger support.

16 Claims, 8 Drawing Sheets

(56) References Cited

U.S. PATENT DOCUMENTS

| | | | | | |
|---|---|---|---|---|---|
| 4,423,757 | A | * | 1/1984 | Broberg, Jr. | 140/123 |
| 4,586,358 | A | * | 5/1986 | Mangiapane | 72/142 |
| 4,689,881 | A | | 9/1987 | Fall | |
| 4,694,869 | A | | 9/1987 | Wolford, Jr. | |
| 4,791,969 | A | | 12/1988 | Cinque | |
| 4,979,715 | A | * | 12/1990 | Rancourt | 248/317 |
| 5,004,020 | A | * | 4/1991 | Meinershagen | 140/93.6 |
| 5,012,624 | A | | 5/1991 | Dahlgren | |
| 5,363,525 | A | | 11/1994 | Andreasen | |
| 5,364,053 | A | * | 11/1994 | Rodgers | 248/302 |
| 5,632,086 | A | * | 5/1997 | Helwig | 29/896.43 |
| 6,659,141 | B2 | * | 12/2003 | Lawrence | 140/106 |
| 6,729,358 | B1 | | 5/2004 | Moffatt | |
| 6,908,250 | B2 | | 6/2005 | Moffatt | |
| 7,143,791 | B1 | * | 12/2006 | Van Loon | 140/104 |
| 2007/0125028 | A1 | * | 6/2007 | Lin | 52/506.06 |
| 2007/0137725 | A1 | * | 6/2007 | Conde | 140/106 |
| 2007/0209732 | A1 | * | 9/2007 | Conde | 140/102.5 |

OTHER PUBLICATIONS

Photograph of early bending tool design, in public use since 2002.

* cited by examiner

SYSTEM FOR PREPARING PRE-ASSEMBLED HANGER SUPPORTS

FIELD OF THE INVENTION

The field of the invention generally relates to construction tooling, and more particularly to construction tooling used to make hanger supports for suspended ceilings.

BACKGROUND OF THE INVENTION AND RELATED ART

It is common for dropped or false ceilings in office buildings, warehouses and the like to be suspended from an overhead support structure. The suspended ceiling typically comprises a frame network that is suspended by hanger supports made from fasteners and structural wire, and removable panels which are supported by the frame. Removal of the panels provides access to electrical wiring, telephone wiring, plumbing and ventilation ductwork, etc., that is located in the space between the suspended ceiling and the overlying support members.

As a result of the distance between the ground level and the overhead support members, as well as the number of hanger supports required to suspending the frame network, it can be extremely inconvenient and time consuming for an installer to carry fasteners, wire, and tools up and down a ladder and to move the ladder from location to location. Accordingly, hanger support assembly systems have been developed which permit the installer to secure a fastener to an overhead support structure and to install the structural wire to the fastener in situ while remaining on the ground. These systems typically require the fastening tool to be attached to an extension pole and lifted overhead to install the wire and fastener. While potentially saving time by avoiding the need to climb up and down a ladder, the quality of the connections between the structural wires and the fasteners attached to the overlying support members can suffer, resulting in costly and time-consuming rework or an inadequately suspended frame network.

SUMMARY OF THE INVENTION

As broadly described herein, a representative embodiment of the present invention resides in a system for preparing a pre-assembled hanger support that facilitates the suspension of the frame of a dropped or false ceiling. The system includes a hanger clip and a structural wire having a bight with a transverse tail extending away from the shaft of the structural wire. The system also includes means for restraining the transverse tail of the bight. The system further includes means for rotating the shaft of the structural wire, so that the transverse tail is drawn toward and wrapped around the shaft to form an eyelet in which the hanger clip is secured.

As broadly described herein, another representative embodiment of the present invention resides in a system for preparing a pre-assembled hanger support. The system includes a bending tool operable to form a bight in a distal end of a structural wire with a transverse tail extending away from the shaft of the structural wire. The system also includes a wrapping tool that further includes: a drive rotor having a clip attachment interface that removably supports a hanger clip and which provides selective rotation of the hanger clip and the structural wire; a wire support brace that supports the shaft of the structural wire in substantial alignment with the axis of rotation of the drive rotor; and a tail stop positioned to restrain the rotation of the transverse tail. The hanger clip is supported about the structural wire and positioned within the bight, and then installed onto the clip attachment interface. Subsequently, selective rotation of the drive rotor rotates the hanger clip and shaft of the structural wire and causes the restrained transverse tail to wrap around the shaft and secure the hanger clip within an eyelet formed in the structural wire, forming the pre-assembled hanger support.

The present invention also includes a method for securing a hanger clip to a structural wire to form a pre-assembled hanger support that facilitates the installation of a dropped or false ceiling structure. The method includes forming a U-shaped bight in the distal end of a structural wire, the bight being formed to comprise a transverse tail extending away from the shaft of the structural wire. The method also includes positioning a hanger clip about the structural wire and within the bight, and rotatably supporting the shaft of the structural wire while restraining the rotation of the transverse tail. The method further includes rotating the hanger clip, the bight and the shaft of the structural wire to cause the transverse tail to wrap around the shaft and secure the hanger clip within an eyelet formed in the structural wire, forming the pre-assembled hanger support.

BRIEF DESCRIPTION OF THE DRAWINGS

Features and advantages of the present invention will be apparent from the detailed description that follows, and when taken in conjunction with the accompanying drawings together illustrate, by way of example, features of the invention. It will be readily appreciated that these drawings merely depict representative embodiments of the present invention and are not to be considered limiting of its scope, and that the components of the invention, as generally described and illustrated in the figures herein, could be arranged and designed in a variety of different configurations. Nonetheless, the present invention will be described and explained with additional specificity and detail through the use of the accompanying drawings, in which.

DETAILED DESCRIPTION OF EXEMPLARY EMBODIMENTS

The following detailed description makes reference to the accompanying drawings, which form a part thereof and in which are shown, by way of illustration, various representative embodiments in which the invention can be practiced. While these embodiments are described in sufficient detail to enable those skilled in the art to practice the invention, it should be understood that other embodiments can be realized and that various changes can be made without departing from the spirit and scope of the present invention. As such, the following detailed description is not intended to limit the scope of the invention as it is claimed, but rather is presented for purposes of illustration, to describe the features and characteristics of the representative embodiments, and to sufficiently enable one skilled in the art to practice the invention. Accordingly, the scope of the present invention is to be defined solely by the appended claims.

Furthermore, the following detailed description of representative embodiments of the invention will best understood with reference to the accompanying drawings, wherein the elements and features of the embodiments are designated by numerals throughout.

Illustrated in FIGS. 1-11 are several representative embodiments of a system for preparing pre-assembled hanger supports, which embodiments also include various methods for fastening a structural wire to a hanger clip prior to attaching the resulting hanger support assembly to an overlying support member. As described herein, the system and methods can provide significant advantages and benefits over prior related devices and methods for preparing and installing structural wire hanger supports used to suspend dropped or false ceilings from an overhead support structure. However, the recited advantages are not meant to be limiting in any way, as one skilled in the art will appreciate that other advantages may also be realized upon practicing the invention.

Figure 1:
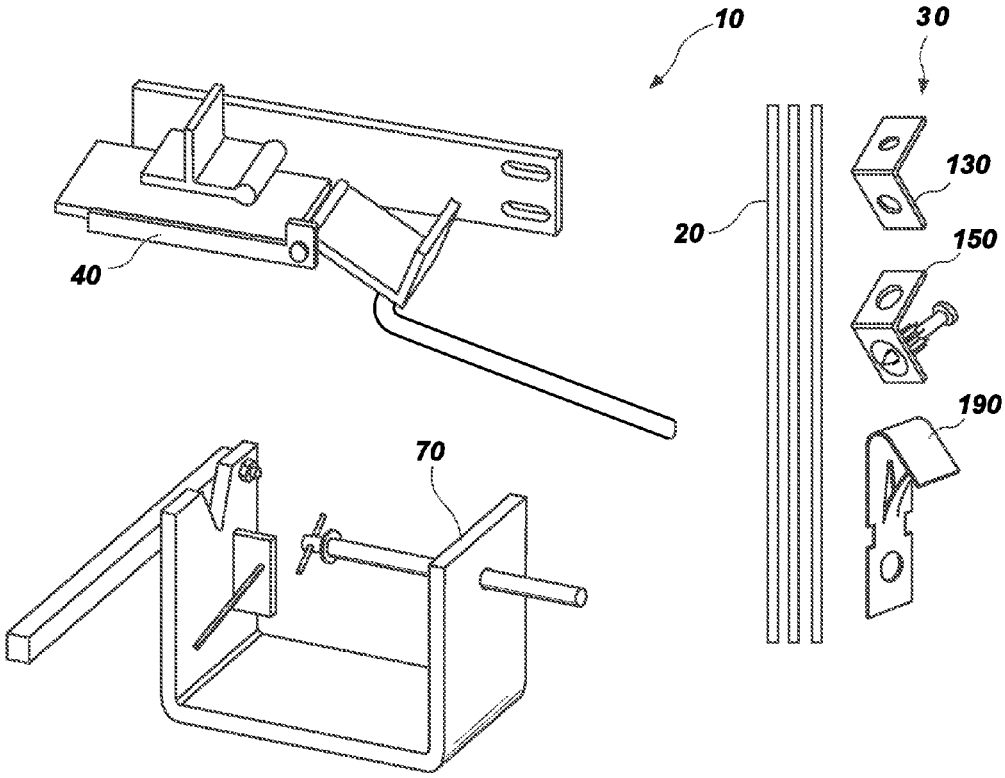
FIG. 1 illustrates a system for preparing pre-assembled hanger supports, in accordance with a representative embodiment of the present invention.

FIG. 1 illustrates a system 10 for preparing pre-assembled hanger supports, in accordance with a representative embodiment of the present invention. The system can include a bending tool 40 used to bend one end of a structural wire 20 into a bight having a transverse tail extending away from the unbent shaft of the structural wire. The system can further include a wrapping tool 70 used to wrap the transverse tail of the bight around the shaft of the wire to form an eyelet into which a hanger clip 30, such as one of exemplary hanger clips 130, 150 and 190, can be secured. In one aspect, the pre-assembled hanger support can be of the type used to suspend the frame of a dropped or false ceiling from an overhead support structure, such as wooden, concrete, and steel beams, or formed structural steel members such as C or Z Purlin, etc.

Figure 2:
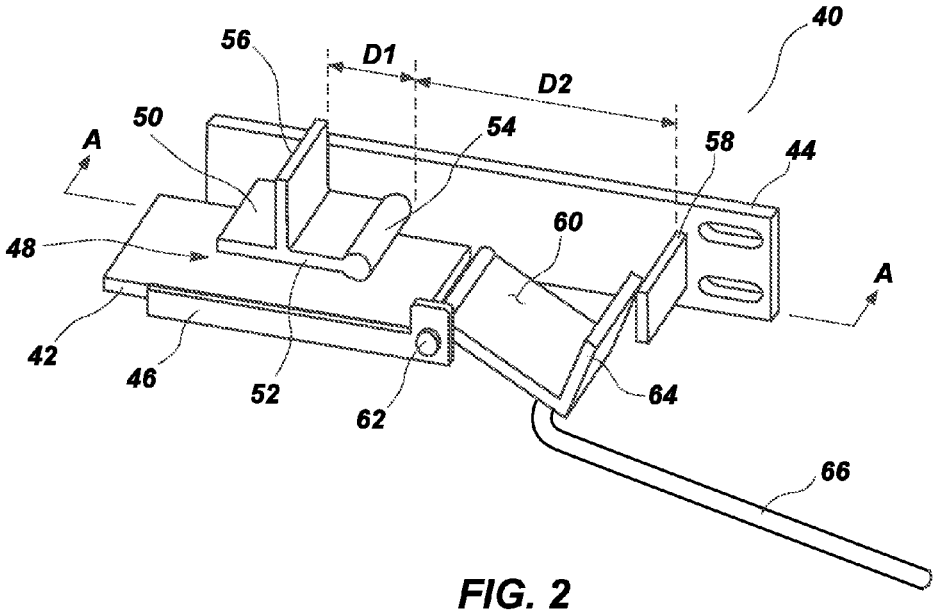
FIG. 2 illustrates a perspective view of the bending tool of FIG. 1.

The bending tool 40 of FIG. 1 is illustrated in more detail in FIG. 2. The bending tool 40 can include a base plate 42 with a tall side plate 44 located to one side of the base plate and a short side plate 46 located to the other. The tall side plate 44 can be longer than both the base plate and the short side plate, with the base plate and short side plate reaching only the center region of the bending tool. The inside end of the short side plate can extend further towards the center of the region of the bending tool and can include a provision, such as a thru-hole, for supporting one end of a hinge 62. The other end of the hinge can be support with another provision, such as a corresponding thru-hole, formed into the long side plate, so that the hinge spans the distance between the short and long side plates and is positioned adjacent and parallel to the inside end of the base plate 42.

A combination die 50 having the general shape of an inverted "T" can extend laterally from the tall side plate 44 over the base plate. A crosspiece 52 of the combination die can be located a pre-determined height above the base plate 42 so that an open-sided gap 48 exists between the base plate and the bottom surface of the crosspiece (see, and with the open side of the gap being towards the short side plate. The combination die 50 can further include a bight die 54 having a bulbous, rounded end located at the forward, inside edge of the cross-piece 52, and a tail die 56 extending upwards from the center of the cross-piece at a pre-determined distance D1 from the forward edge of the bight die. As described below, the pre-determined distance D1 can determine the length of the looped portion of the bight, which can in turn determine the size of the eyelet securing the hanger clip in the pre-assembled hanger support.

In the representative embodiment illustrated in FIG. 2, a hinge plate 60 can be rotatably supported at one end with hinge 62, and can have a die press 64 projecting laterally outwards from the opposite, swinging end of the hinge plate. The die press, hinge plate and hinge can be configured so that the leading edge of the die press 64 can rotate freely from a position below the plane of the base plate 42 (see FIG. 3A) to the junction where the tail die 56 extends upwards from the cross-piece 52 of the combination die 50 (see FIG. 3E). A lever arm 66 can be attached to the hinge plate 60 to assist a user in applying sufficient pressure to bend one or more structural wires with the bending tool 40 at the same time.

The bending tool 40 can further include an end stop 58 extending laterally from the tall side plate 44 beyond the arc of the die press 64, and at a pre-determined distance D2 from the forward edge of the bight die 54. As will be described below, the distance D2 can determine the length of the transverse tail extending away from the shaft of the structural wire, and which in turn can determine the number of coils of wire formed when the transverse tail is wrapped around the shaft of the structural wire into the plurality of coils forming the base of the eyelet.

The operation of using the bending tool 40 to bend the structural wire 20 into a bight having a transverse tail extending away from the unbent shaft of the structural wire is illustrated in FIGS. 3A-3E. Beginning with FIG. 3A, the hinge plate 60 can be rotated downwards to the extent that the leading edge of the die press 64 is below the plane of the base plate 42. This allows one or more structural wires 20 to be installed into the open-ended gap 48 between the base plate and the cross-piece 52 of the combination die 50. Furthermore, the one or more structural wires 20 can be positioned within the bending tool 40 so that the tip of the distal end 22 of the wire abuts the end stop 58.

Figure 3A:
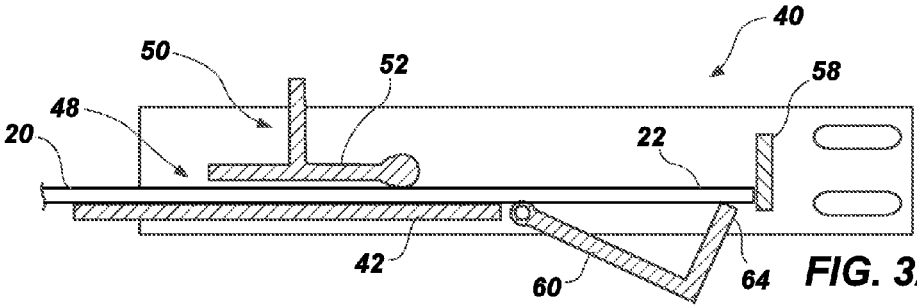
FIGS. 3A-3E together illustrate the operation of bending a structural wire in the bending tool of FIG. 2, as viewed from Section Line A-A.
Figure 3B:
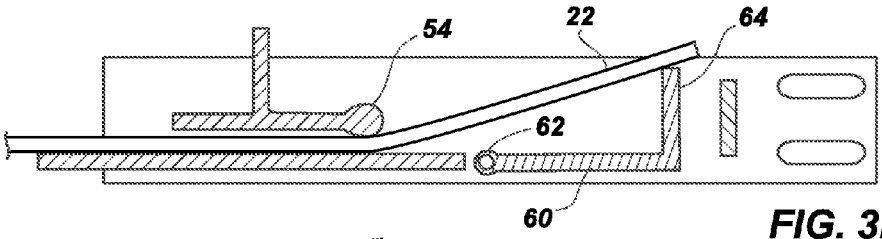
Figure 3C:
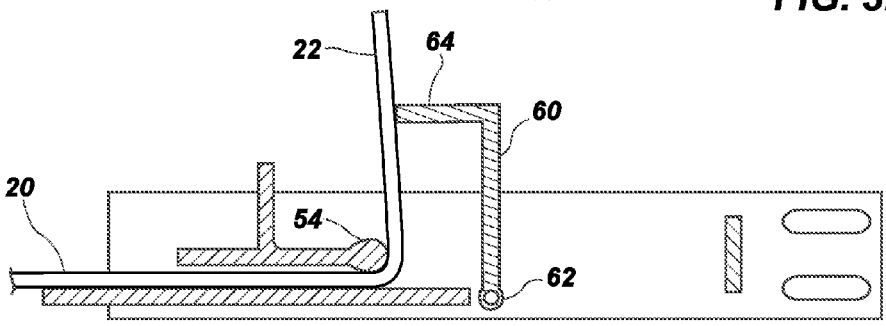
Figure 3D:
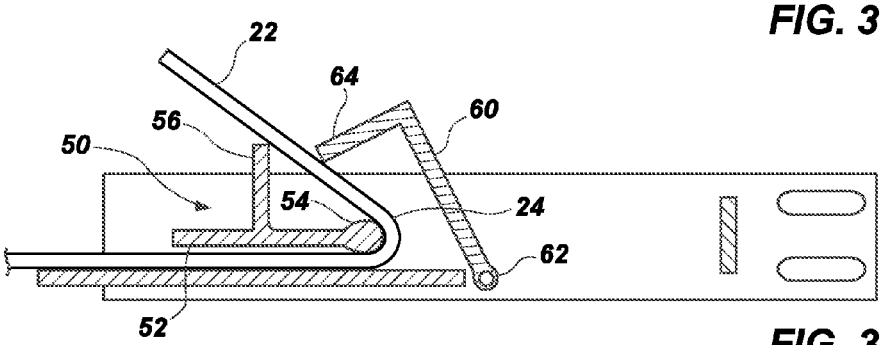
Figure 3E:
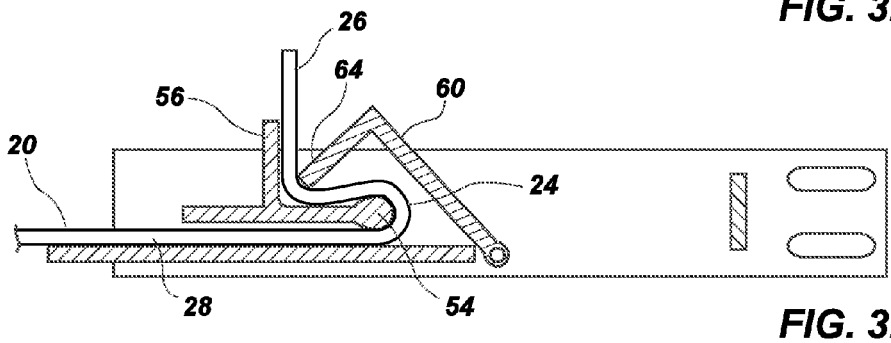

As shown in FIG. 3B, the hinge plate 60 can next be rotated upward so that the leading edge of the die press 64 contacts the distal end 22 of the structural wire 20 and forces it upwards, to begin bending the wire about the bight die 54. As the hinge plate 60 continues to rotate over and around the hinge 62, as shown in FIGS. 3C and 3D, the distal end of the structural wire can be bent around the bulbous end of the bight die, imparting a U-shaped curve, or "bight" 24, into the distal end of the wire. Upon further rotation of the hinge plate 60, the die press 64 can continue to force the distal end of the wire around the bight die 54 until it eventually contacts the tail die 56 extending upwards from the crosspiece 52 of the combination die 50, as shown in FIG. 3D. Continued rotation of the hinge plate 60 forces the die press 64 further into the junction between the tail die 56 and the cross-piece 52, as shown in FIG. 3E, thus imparting a partial reverse bend in the free end of the bight and forming a transverse tail 26 extending away from the unbent shaft 28 of the structural wire 20. After the die press has been backed away from the combination die 50 by rotating the hinge plate 60 in the reverse direction, the bent structural wire 20 can be removed from the bending tool by sliding the wire sideways out through the open end of the gap 48.

Figure 4A:
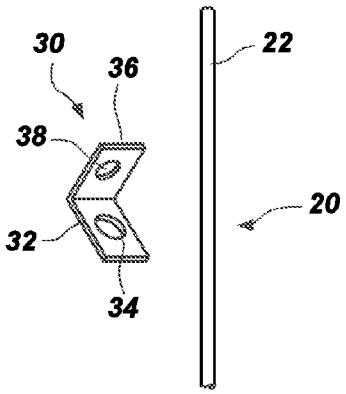
FIGS. 4A-4C together illustrate the preparation and initial assembly of the structural wires and hanger clips of FIG. 1.
Figure 4B:
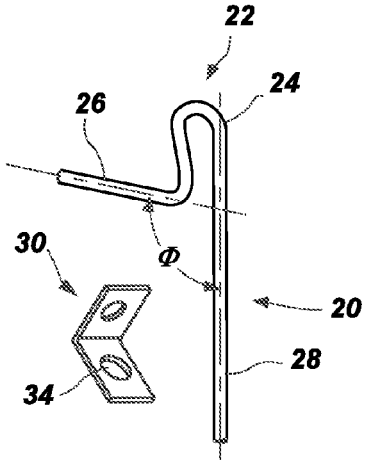
Figure 4C:
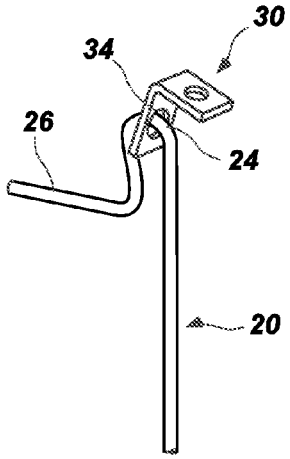

Illustrated in FIGS. 4A-4C is the preparation and initial loose assembly of the structural wires 20 and hanger clips 30. As shown in FIG. 4A, the hanger clip 30 can be an L-shaped bracket having a wire attachment side 32 and a support attachment side 36. In the embodiment shown, the wire attachment side can be slightly longer in length and can have a wire aperture 34 which is slightly larger than the fastener aperture 38 formed in the support attachment side. However, other configurations for the hanger clip are also possible, including variations in the length of either end and the size of the apertures, and can be considered to fall within the scope of the present invention.

A hanger clip 30 and a structural wire 20 with an unbent distal end 22 are illustrated in FIG. 4A. After bending with the bending tool described above, the distal end 22 of the structural wire can have a bight 24 with a transverse tail 26 extending outwardly from the shaft 28, and without crossing the shaft, as shown in FIG. 4B. In one aspect the transverse tail 26 can be bent at an angle Φ extending outwardly and away from the shaft 28 of the structural wire between about 70 degrees and 110 degrees relative to the long axis shaft. In another aspect transverse tail can be bent at an angle Φ extending outwardly and away between about 80 degrees and 100 degrees relative to the long axis of the shaft.

The hanger clip 30 can be loosely assembled to the structural wire 20 by inserting the free end of transverse tail 26 into the wire aperture 34 of the hanger clip and sliding the bracket up into the curve of the bight 24, as shown in FIG. 4C. In this configuration the loosely assembled structural wire 20 and hanger clip 30 can subsequently be removably supported or coupled into the wrapping tool, which is used to close the bight into an eyelet and secure the hanger clip to the structural wire.

Figure 5:
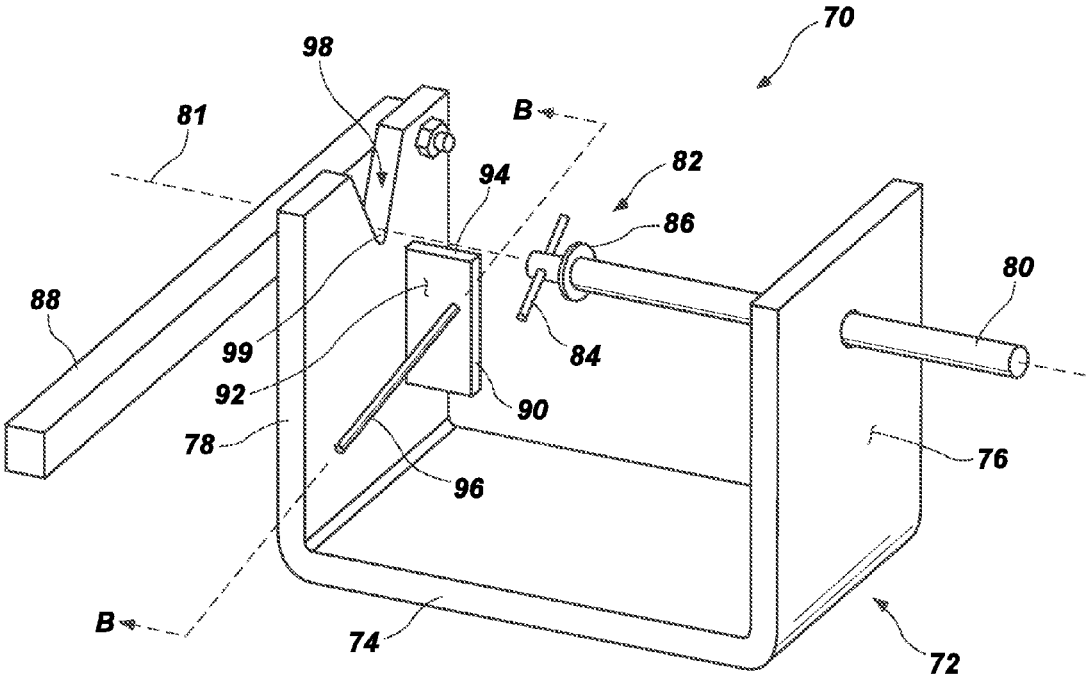
FIG. 5 illustrates a perspective view of the wrapping tool of FIG. 1.

The wrapping tool 70, in accordance with the representative embodiment shown in FIG. 1, is illustrated in more detail in FIG. 5. The wrapping tool 70 can include a generally U-shaped support base 72 comprised of a base plate 74, a drive rotor support 76, and a tail stop support 78. The rotor support 76 can extend vertically upwards from one end of the horizontal base plate to support the distal end of a rotatable drive rotor 80 above the base plate. The tail stop support 78 can extend vertically upwards from the opposite end of the base plate to support a stationary tail stop 90 above the base plate, and proximate to the distal end of the drive rotor. It is to be appreciated, moreover, that configurations for supporting a drive rotor 80 and a tail stop 90 other than the support base 72 shown in FIG. 5 are possible, and can be considered to fall within the scope of the present invention.

The drive rotor 80 can be rotatably supported by the rotor support 76 with a journal surface or sleeve bearing, etc., or may simply pass through an enlarged aperture in the vertical drive rotor support as it extends outwardly away from a drive source (not shown). The drive source can be any type of powered or manual drive source known in the art to selectively rotate the drive rotor about an axis 81 with a torque sufficient to twist the structural wire about itself, such as a motor, turbine, gearing mechanism, linkage, lever arm or crank and the like. Extending from the distal end of the drive rotor 80 can be a clip attachment interface 82 that can removably support or couple the hanger clip described above to the drive rotor, the drive rotor in turn providing selective rotation of the hanger clip, bight and shaft of the structural wire to wrap the transverse tail previously formed into the distal end of the structural wire into an eyelet for securing the hanger clip to the structural wire.

In the representative embodiment illustrated in FIG. 5, the clip attachment interface 82 can include a T-bar 84 extending radially from the tip or distal end of the drive rotor, as well as a side support or disk 86 for laterally supporting the hanger clip in a fixed position relative to the drive rotor. It is to be appreciated that other configurations of the clip attachment interface for removably supporting the hanger clip are also possible, including a manual or automated drill chuck or clamping fixture, etc., and which can also be considered to fall within the scope of the present invention.

Opposite the rotor support 76, the tail stop support 78 can support the stationary or fixed tail stop 90 above the base plate 74. The tail stop can be located proximate to, but not it contact with, the distal end or clip attachment interface 82 of the drive rotor 80. The tail stop 90 can be used to restrain rotation of the transverse tail as the drive rotor rotates the hanger clip and shaft of the structural wire, and can comprise a flat plate having a contact face 92 and an upper edge 94. The tail stop can further include a capture bar 96 extending laterally from the inner edge of the contact face and parallel to the inside face of the tail stop support. The capture bar 96 can be used to capture the transverse tail of the structural shaft and keep it from slipping off the contact face 92 of the tail stop 90 during wrapping of the transverse tail of the bight to form an eyelet.

Figure 6:
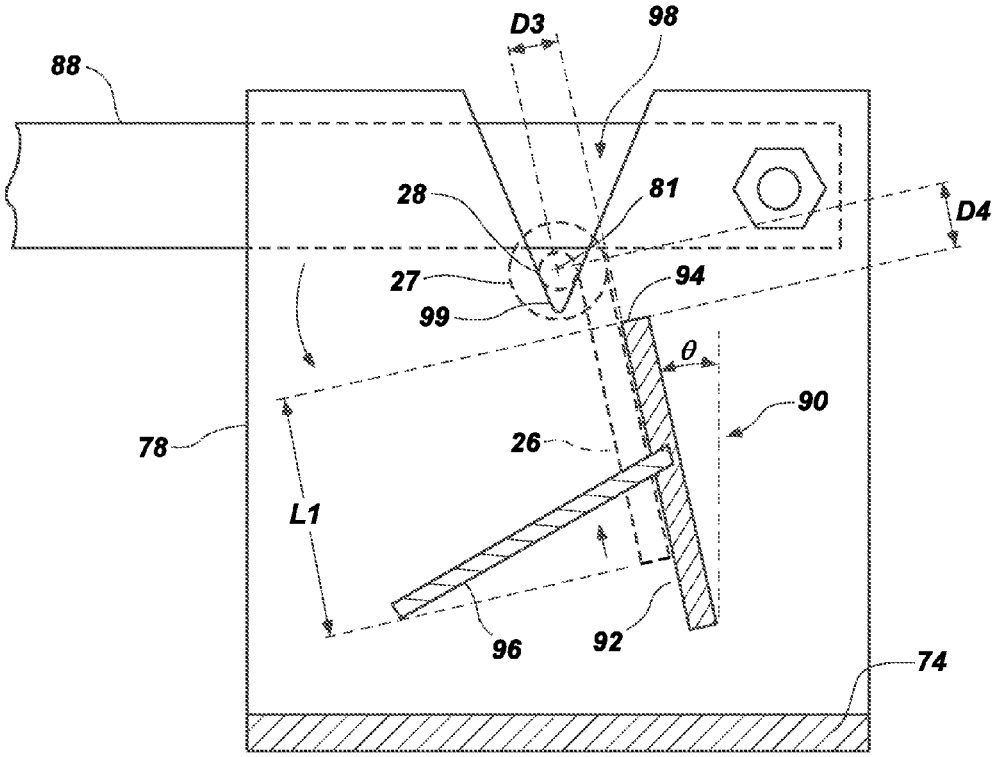
FIG. 6 illustrates a cross-sectional view of the wrapping tool of FIG. 5 as viewed from Section Line B-B.

The tail stop support 78 can further include a wire support brace for supporting the shaft of the structural wire in substantial alignment with the axis of rotation of the drive rotor. In the representative embodiment illustrated in FIG. 5, the wire support brace can comprise a locating V-notch 98 formed into the upper region of the tail stop support 78, and a restraining bar 88 or handle. As shown in FIG. 6, the point 99 of the V-notch can be aligned with the axis of rotation 81 of the drive shaft 80, so that the angled or upward-facing surfaces of the point 99 of the V-notch 98 and bottom surface of the restraining bar 88 can together support and maintain the rotating shaft 28 of the structural wire in substantial alignment with an axis of rotation of the drive rotor during wrapping of the transverse tail of the bight to form an eyelet.

As further shown in FIG. 6, the contact face 92 of the tail stop 90 can be offset a distance D3 from the axis of rotation 81 of the drive rotor and/or the centerline of the shaft 28 of the structural wire located within the V-notch 98. Distance D3 can be about 1× to 2× the diameter of the structural wire, and in one aspect can optimally be about 1.5× the diameter of the structural wire, so as to align the transverse tail 26 with the shaft 28 to form a tight wrap of coils 27 without twisting of the shaft. Furthermore, the tail stop can be movable, or can be adjustably mounted to the tail stop support 78, to allow for structural wires with different diameters.

In one aspect the longitudinal axis of the tail stop 90 can also be orientated at an angle θ from vertical, which angle can range from about 5 degrees to about 45 degrees from vertical, and in one aspect can optimally be about 15 degrees from vertical. In another aspect the longitudinal axis of the tail stop can be orientated at any angle θ from vertical, so long as the distance D3 can be maintained to ensure that the transverse tail can be wrapped around the shaft of the structural wire without twisting of the shaft.

FIG. 6 illustrates another aspect of the present invention in which the upper edge 94 of the tail stop is offset a distance D4 from the axis of rotation 81 of the drive rotor and/or the centerline of the shaft 28 located within the V-notch 98. Distance D4 can determine the length of the stub of the transverse tail 26 that remains after the majority of the transverse tail has been wrapped around the shaft 28 of the structural wire to form the eyelet, because at distance D4 the tail stop 90 ceases to restrain the transverse tail from rotating and allows the eyelet 18 to spin freely in the wrapping tool 70.

Further shown in FIG. 6 is the length L1 of the transverse tail, which length can be approximately determined by the distance D2 between the forward edge of the bight die 54 and the end stop 58 of the bending tool 40, minus the distance D1 between the forward edge of the bight die 54 and the front face of the tail die 56. (see FIG. 2). Length L1 of the transverse tail 26 can establish the number of coils 27 of wire formed when the transverse tail wraps around the shaft 28 of the structural wire to form the base of the eyelet. For instance, configuring length L1 to be equal to at least 3× the circumference of the coils 27 allows the tail stop to restrain the transverse tail for at least three rotations of the drive rotor as the tail is drawn upwards across the contact face 92 of the tail stop, to form a rigid knot having at least three turns or coils 27 about the shaft 28.

Figure 7:
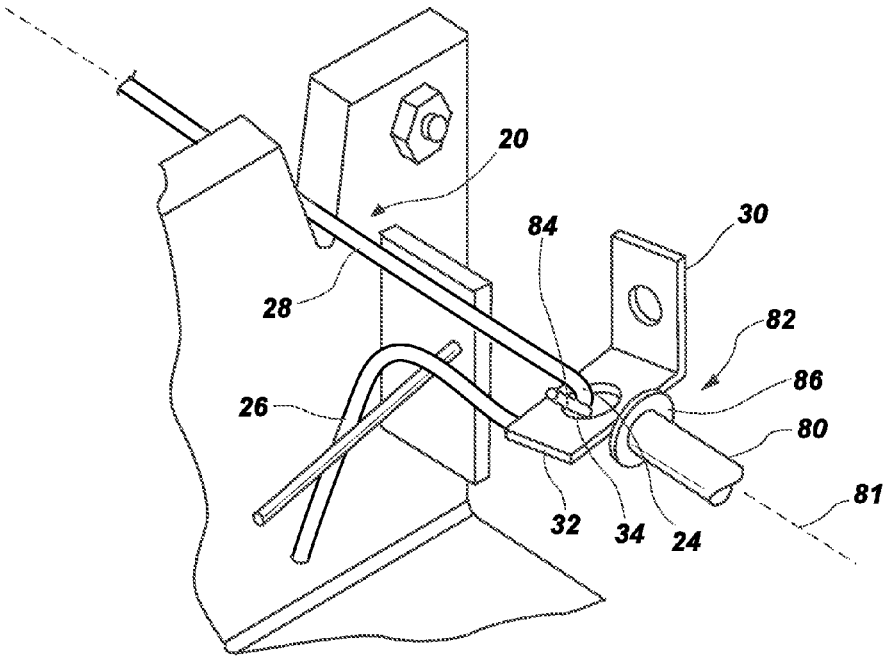
FIG. 7 illustrates a close-up, perspective view of the hanger clip removably supported by the clip attachment interface of the wrapping tool of FIG. 5.

The operation of removably supporting or coupling the structural wire 20 and attached hanger clip 30 of FIG. 4C onto the clip attachment interface 82 of the drive rotor 80 is illustrated in FIG. 7. During attachment the bight aperture 34 formed into the wire attachment side 32 of the hanger clip can be inserted onto one of the posts of the T-bar 84 comprising the clip attachment interface 82. As the bight 24 of the structural wire can also be threaded through the same aperture 34, the opening can be large enough to simultaneously accommodate both structures. With the hanger clip 30 and attached bight 24 inserted all the way up the post of the T-bar, the bight can be slightly offset from the axis of rotation by the radius of the drive rotor so that the shaft of the structural wire is substantially aligned with the axis of rotation. The edge of the hanger clip opposite the tail stop can be supported against the side support disk 86 that extends radially from the drive rotor and adjacent the T-bar, to further secure and orient the hanger clip and to prevent the hanger clip from wobbling about the T-bar during operation.

Illustrated in FIGS. 8A-8D is the operation of wrapping the transverse tail 26 about the shaft 28 of the structural wire to close the bight 24 into an eyelet and secure the hanger clip 30 to the structural wire 20. Beginning with FIG. 8A, the hanger clip 30 and attached bight 24 of the structural wire 20 can be removably supported or coupled in the clip attachment interface 82, as described above. At the same time, the transverse tail of the bight can be hooked over the capture bar 96 so that any initial movement of the drive rotor 80 will rotate the transverse tail 26 into the face 92 of the tail stop 90. As noted in the drawings, the selective rotation of the drive rotor can be counter-clockwise as viewed from the proximal end of the drive rotor looking towards the distal end of the drive rotor.

Figure 8A:
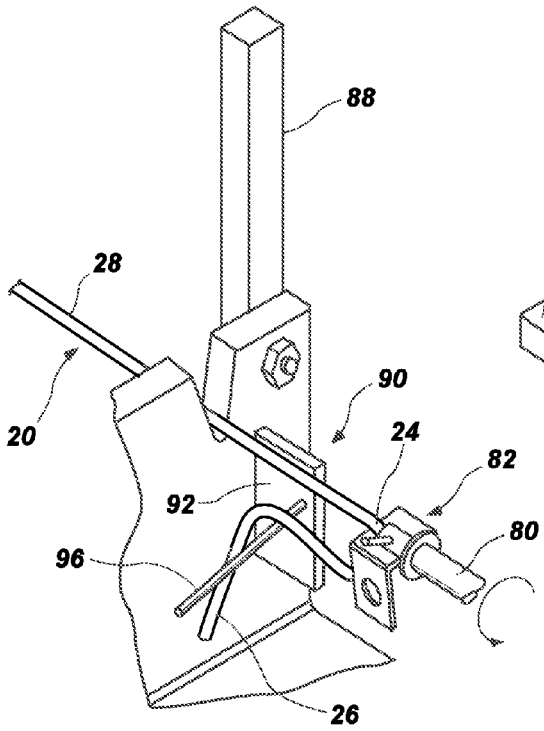
FIGS. 8A-8D together illustrate using the wrapping tool of FIG. 5 to wrap the bight into an eyelet, to secure the hanger clip to the structural wire.
Figure 8B:
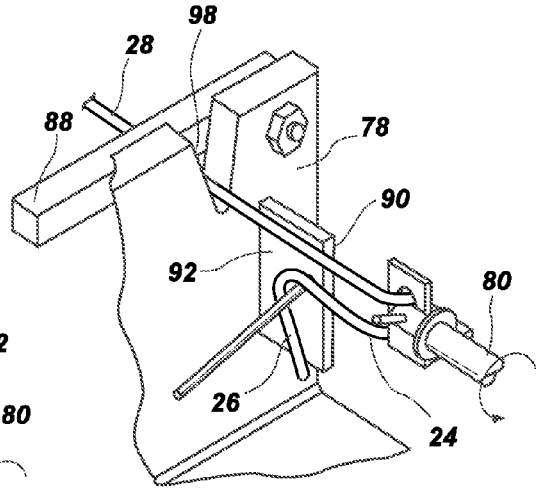
Figure 8C:
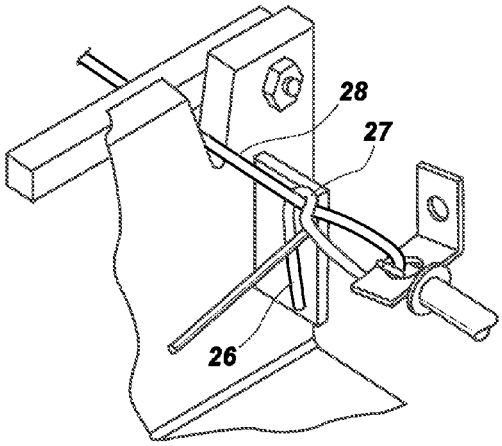
Figure 8D:
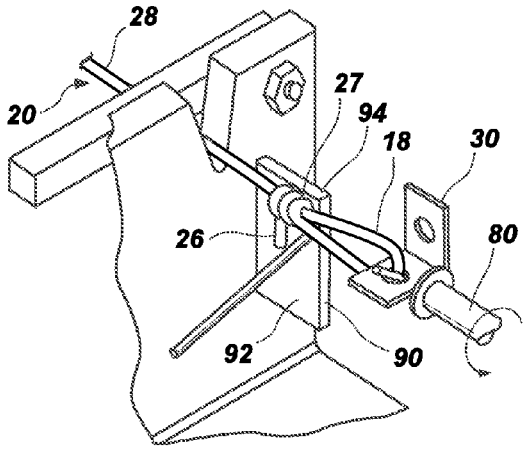

As illustrated in FIG. 8B, the restraining bar 88 can be closed to rotatably support the shaft 28 of the structural wire in the V-notch 98 of the wire support brace 78, and the drive rotor 80 can begin to rotate counterclockwise to draw the transverse tail 26 against the contact face 92 of the tail stop 90. This can begin to close the open U-shaped curve of the bight 24 into a looped eyelet. As further illustrated in FIG. 8C, additional rotation of the drive rotor through about another ¼ turn can pull the partial reverse bend of the transverse tail 26 over the top of the shaft 28 to begin wrapping of the first coil 27 around the shaft. And as shown in FIG. 8D, continued rotation of the drive rotor 80 will continue to pull the length of the transverse tail 26 up the contact face 92 and over the top of the shaft 28 to form additional coils 27, until the free end of the transverse tail slips over the upper edge 94 of the tail stop 90 to stop the wrapping of the coils and to allow the looped eyelet 18 of the structural wire 20 to rotate freely with the drive rotor.

Figure 9:
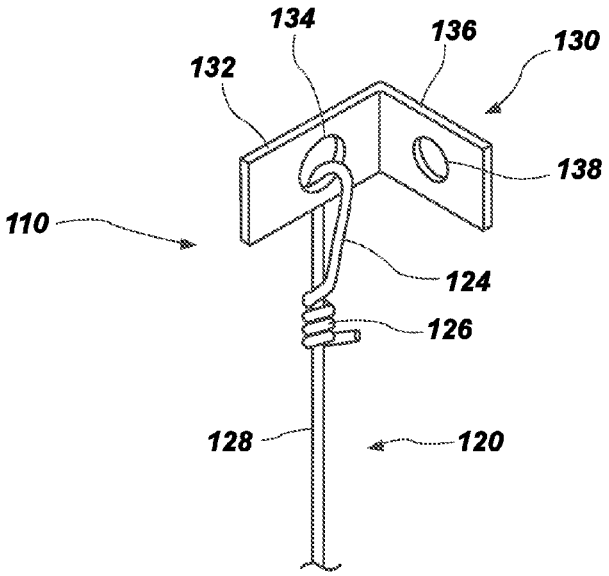
FIG. 9 illustrates a pre-assembled hanger support, in accordance with a representative embodiment of the present invention.

Shown in FIG. 9 is the pre-assembled hanger support 110 in accordance with a representative embodiment of the present invention. The hanger support can include the structural wire 120 attached to the hanger clip or angle clip 130 with the looped eyelet 124. The eyelet can have a plurality of coils 126 wrapped around the shaft 128 of the structural wire to prevent the eyelet from opening. In one aspect of the invention the plurality of coils can include at least three coils tightly wrapped around the shaft within an inch of the eyelet.

Figure 10:
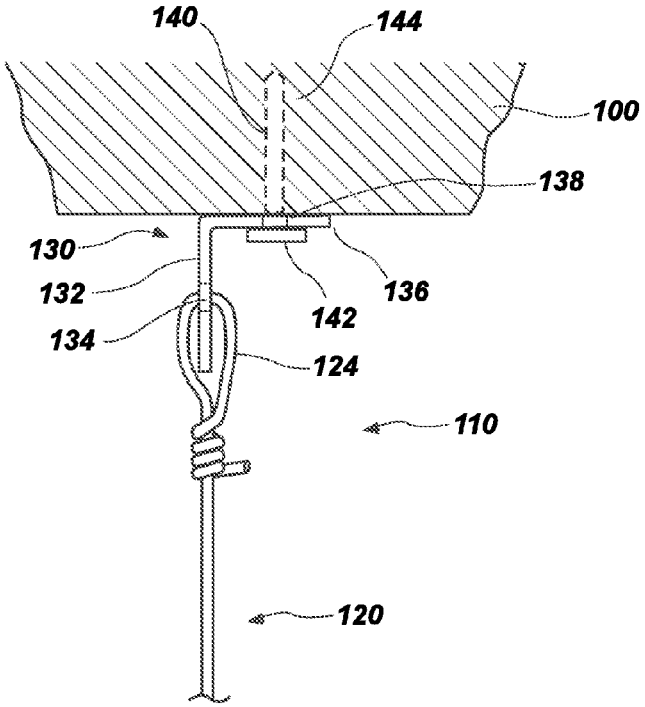
FIG. 10 illustrates the attachment of the pre-assembled hanger support of FIG. 9 to an overlying support member, in accordance with a representative embodiment of the present invention.

The eyelet 124 can be threaded through the wire aperture 134 in the wire attachment side 132 of the angle clip 130, leaving the support attachment side 136 and fastener aperture 138 exposed for attachment to an overlying structural member or support 100, as shown in FIG. 10. Any common fastener 140, such as a nail, screw, bolt or rivet, etc., can be used to attach the hanger support 110 to the overlying structural member 100, with the body 144 of the fastener 140 projecting upwards through the fastener aperture 138 into the structural member 100, as the fastener head 142 holds the support attachment side 136 of the angle clip 130 firmly against the bottom face of the overlying structural member.

Figure 11A:
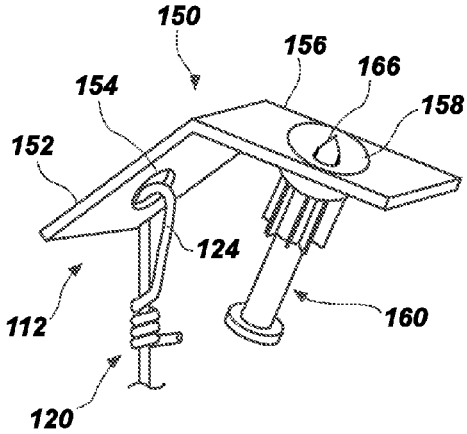
FIGS. 11A-11B together illustrate a pre-assembled hanger support and the attachment of the same to an overlying support member, in accordance with another representative embodiment of the present invention.
Figure 11B:
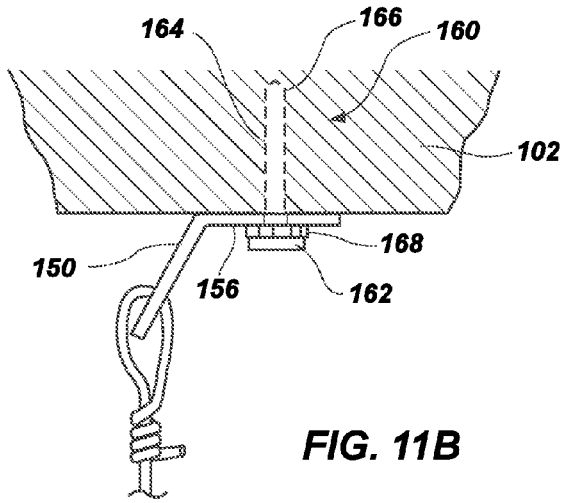

Illustrated in FIGS. 11A and 11B is a pre-assembled hanger support 112 that can be attached to an overlying concrete beam 102 or panel, in accordance with another representative embodiment of the present invention. In this embodiment the eyelet 124 of the structure wire 120 can be threaded through a wire aperture 154 in the wire attachment side 152 of the concrete hanger clip 150, leaving the support attachment side 156 with a hardened concrete pin 160 inserted through the bottom of a bowl-shaped cavity 158. During installation the flat face of the clip's support attachment side 156 can be abutted against the concrete support 102 so that the tip 166 of the concrete pin 160 is adjacent to the support. The body 164 of the concrete pin 160 can then driven into the concrete support manually or using a power tool such as a pneumatic hammer or powder-actuated tool. Once installed, the head 162 of the concrete pin can hold the support attachment side 156 of the hanger clip 150 firmly against the bottom face of the overlying concrete support 102.

Figure 12A:
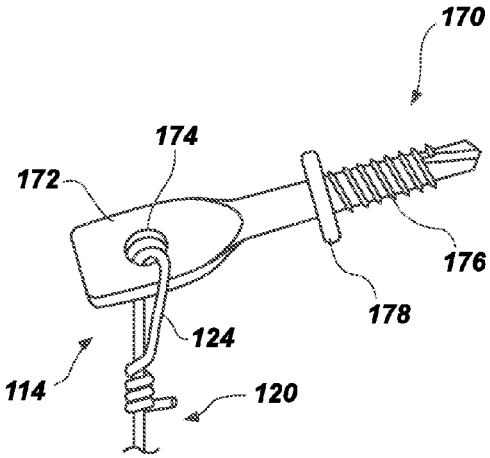
FIGS. 12A-12B together illustrate a pre-assembled hanger support and the attachment of the same to an overlying support member, in accordance with yet another representative embodiment of the present invention.
Figure 12B:
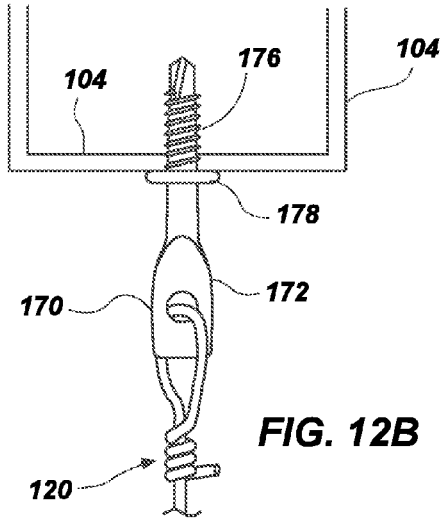

Illustrated in FIGS. 12A and 12B is a pre-assembled hanger support 114 that can be attached to an overlying support member such as a steel beam 104 or joist, in accordance with yet another representative embodiment of the present invention. In this embodiment the eyelet 124 of the structure wire 120 can be threaded through a wire aperture 174 in the flattened wire attachment end 172 of the metal decking or lag screw 170, leaving a screw end 176 and base disc 178 available for attachment to the beam 104. Tooling can be used to grasp and rotate the wire attachment end 172 during installation to drive the threaded screw end 176 into and through the beam's thickness, until the base disc 178 contacts the bottom surface of the support beam 104 or joist and prohibits further progress.

Figure 13A:
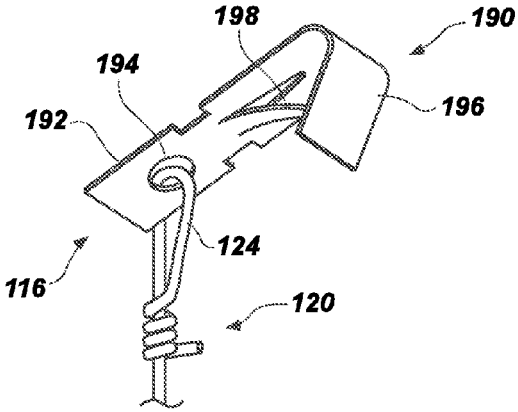
FIGS. 13A-13B together illustrate a pre-assembled hanger support and the attachment of the same to an overlying support member, in accordance with yet another representative embodiment of the present invention.
Figure 13B:
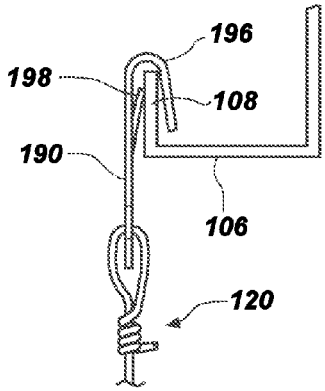

Illustrated in FIGS. 13A and 13B is a pre-assembled hanger support 116 that can be attached to an overlying formed structural steel member 106 such as C or Z Purlin, etc., in accordance with yet another representative embodiment of the present invention. In this embodiment the eyelet 124 of the structure wire 120 can be threaded through a wire aperture 194 in the lower attachment end 192 of a ladd clip 190, leaving the upper end having the curved hook 196 and tension member 198 for attachment to the upwardly-projecting lip of the 108 of the formed structural steel member 106.

The angle clips 130, concrete clips 150, lag screws 170 and ladd clips 190 described in FIGS. 9-13B are illustrative examples of some of the more common types of hanger clips that can be attached to the structural wire 120 using the representative system for preparing pre-assembled hanger supports described herein, thereby forming a variety of pre-assembled hanger supports suitable for a range of applications. It is to be appreciated, furthermore, that other types of hanger clips and structural wires not specifically illustrated herein can also be used with the present invention to form pre-assembled hanger supports, and can therefore be considered to fall within the scope of the present invention.

Figure 14:
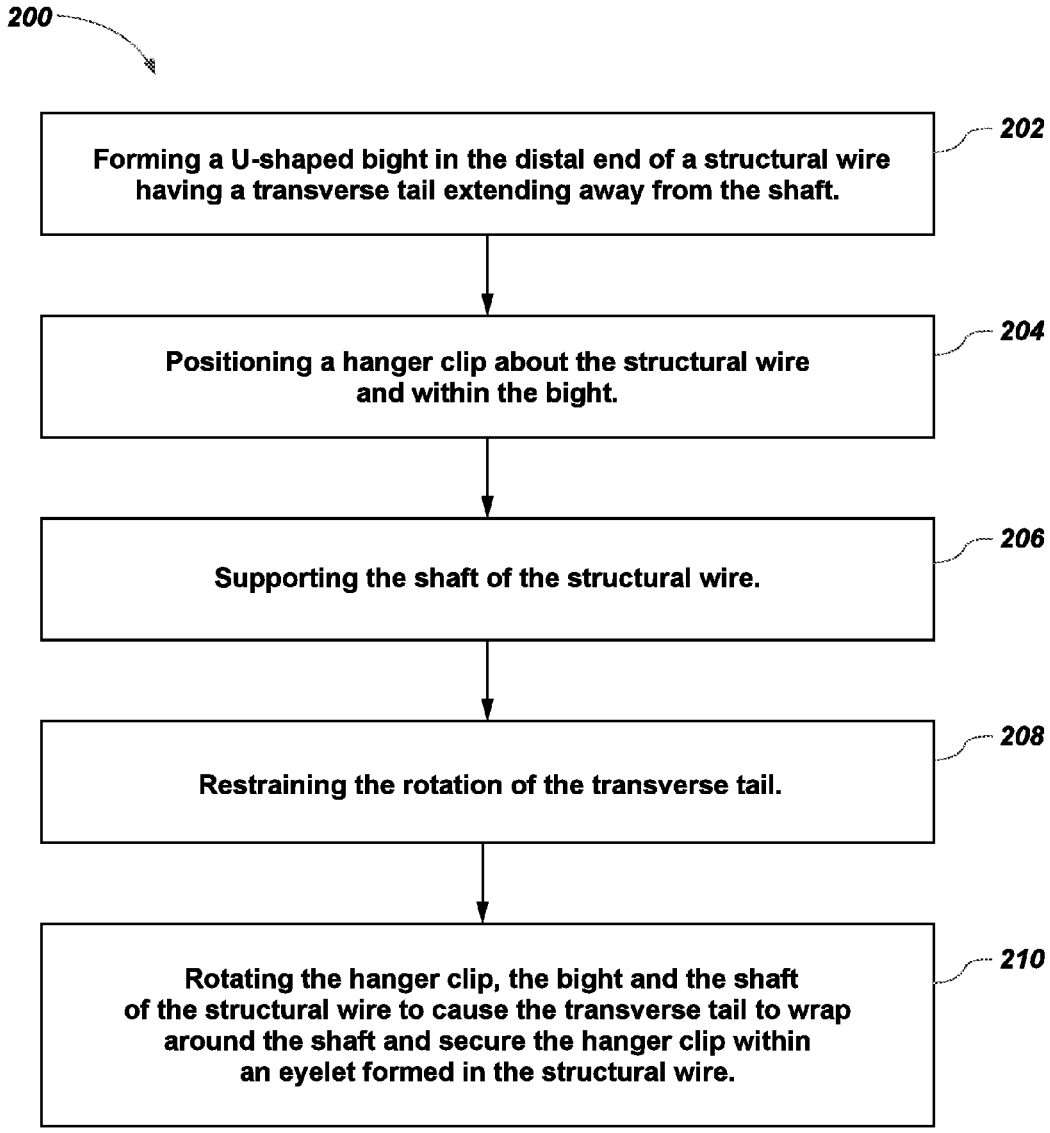
FIG. 14 illustrates a method for fastening a structural wire to a hanger clip prior to installing the hanger clip/structural wire assembly into a ceiling structure, in accordance with a representative embodiment of the present invention.

A flowchart depicting a method 200 for securing a hanger clip to a structural wire to form a pre-assembled hanger support that facilitates installation of a ceiling structure is illustrated in FIG. 14, in accordance with a representative embodiment of the present invention. The method includes forming 202 a U-shaped bight in the distal end of a structural wire having a transverse tail extending away from a shaft of the structural wire. The method also includes positioning 204 a hanger clip about the structural wire and within the bight. The method further includes supporting 206 the shaft of the structural wire, restraining 208 the rotation of the transverse tail and rotating 210 the hanger clip, the bight and the shaft of the structural wire to cause the transverse tail to wrap around the shaft and secure the hanger clip within an eyelet formed in the structural wire, to form a pre-assembled hanger support.

The system and method of the present invention for pre-assembling support hangers from structural wire and hanger clips, prior to installing the hanger clips to the overhead support structure, can provide distinct advantage over the prior art. For instance, the quality of the connection between the structural wire and the hanger clip can be assured with a consistently-formed eyelet having three or more coils to maintain a secure connection between the structural wire tied and the hanger clip. Similarly, the size of the eyelet loop controls the flexibility and play between the hanger clip and the structural wire, and can be pre-determined by the distance D1 between the bight die and the tail die (see FIG. 2).

In one aspect, the system of the present invention can further comprise a portable bench version that incorporates the bending tool and the wrapping tool with a transportable base or bench, allowing the system to be transported to the construction site to provide the installer with the capability to pre-assemble the structural hangers on-site, so as to avoid transporting the bulky pre-assembled hangers from a central storage or manufacturing facility.

The pre-assembled hanger supports can be further advantageous over the prior art by minimizing the time the installer spends mounting the hanger supports to the overhead support structure, since each pre-assembled hanger can be quickly attached to an overlying support member with a nail gun driving a nail through the fastener aperture (or with a similar powered fastening system), rather than attaching the structural wire to the hanger clip or fastener using tooling mounted on the end of an extension pole.

The foregoing detailed description describes the invention with reference to specific representative embodiments. However, it will be appreciated that various modifications and changes can be made without departing from the scope of the present invention as set forth in the appended claims. The detailed description and accompanying drawings are to be regarded as illustrative, rather than restrictive, and any such modifications or changes are intended to fall within the scope of the present invention as described and set forth herein.

More specifically, while illustrative representative embodiments of the invention have been described herein, the present invention is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, any steps recited in any method or process claims, furthermore, may be executed in any order and are not limited to the order presented in the claims. The term "preferably" is also non-exclusive where it is intended to mean "preferably, but not limited to." Accordingly, the scope of the invention should be determined solely by the appended claims and their legal equivalents, rather than by the descriptions and examples given above.

What is claimed and desired to be secured by letters patent is:

1. A system for preparing a pre-assembled hanger support, comprising:

a bending tool operable to form a bight in a distal end of a structural wire, the bight having a transverse tail extending away from a shaft of the structural wire; and a wrapping tool comprising:

a drive rotor having a clip attachment interface that removably supports a hanger clip, and that provides selective rotation of the hanger clip which imparts rotation to the structural wire;

a wire support brace that supports the shaft of the structural wire in substantial co-axial alignment with an axis of rotation of the drive rotor; and a tail stop positioned to restrain rotation of the transverse tail, wherein the hanger clip is supported about the structural wire and positioned within the bight, and wherein the clip attachment interface includes a T-bar extending through a portion of the hanger clip through which the structural wire also extends, wherein rotation of the drive rotor rotates the hanger clip and shaft of the structural wire while maintaining the co-axial alignment, thereby causing the restrained transverse tail to wrap around the shaft and secure the hanger clip within an eyelet formed in the structural wire to form a pre-assembled hanger support.

2. The system of claim 1, further comprising a portable bench system incorporating the bending tool and the wrapping tool for fastening the structural wire to the hanger clip on-site and prior to installing the hanger support into a ceiling structure.

3. The system of claim 1, wherein the bending tool comprises:

a combination die comprising:

a bight die having a bulbous end extending forward from a cross-piece for forming a substantially U-shaped bight in the end of the structural wire; and a tail die extending upward from a central portion of the combination die for forming a partial reverse bend extending away from the shaft in a free end of the bight; and a hinge plate comprising:

a die press extending perpendicular from the hinge plate;

a hinge located forward from the bight die; and wherein the hinge plate rotates on the hinge causing structural wire to bend about the bight die and subsequently engage an end portion of the structural wire between the die press and the combination die at a point between the bight die and the tail die thus creating a bight and a transverse tail which extends away from the shaft of the structural wire.

4. The system of claim 3, wherein the bight die and tail die are formed of two substantially planar plates being connected and substantially orthogonal one to another.

5. The system of claim 1, wherein the bending tool further comprises a wire stop for locating and indexing the structural wire in the bending tool to provide a transverse tail of predetermined length.

6. The system of claim 5, wherein the tail stop is configured to restrain the transverse tail of predetermined length for at least three rotations of the drive rotor to form a rigid knot having at least three turns about the shaft of the structural wire.

7. The system of claim 1, wherein the transverse tail is bent at an angle extending away from the shaft of the structural wire between about 70degrees and 110degrees relative to the shaft.

8. The system of claim 7, wherein the transverse tail is bent at an angle extending away from the shaft of the structural wire between about 80degrees and 100degrees relative to the shaft.

9. The system of claim 1, wherein the T-bar extends radially from a tip of the drive rotor.

10. The system of claim 9, wherein the clip attachment interface further comprises a side support surface affixed to the drive rotor, being spaced a distance from the end of the drive rotor for laterally supporting the hanger clip in a fixed position relative to the drive rotor.

11. The system of claim 10, wherein the side support surface is a disk extending radially from the drive rotor and adjacent the T-bar.

12. The system of claim 1, wherein a plane of a contact face of the tail stop is offset from the axis of rotation of the drive rotor between about 1× and 2× of a diameter of the structural wire, to align the transverse tail with the shaft to form a tight coil wrap without twisting of the shaft.

13. A system for preparing a pre-assembled hanger support that facilitates suspension of a frame of a dropped ceiling, the system comprising:

a hanger clip;

a structural wire forming a bight having a transverse tail extending away from a shaft of the structural wire, the structural wire passing through an opening of the hanger clip, the hanger clip being positioned within the bight of the structural wire;

a tail stop being spaced away from the shaft of the structural wire, the tail stop having a planar contact face for restraining the transverse tail of the bight, wherein the tail stop further comprises a capture bar configured to prevent the transverse tail of the structural wire from slipping off the planar contact face; and a driveshaft having a clip interface for rotating the hanger clip and therefore the shaft of the structural wire, wherein the clip interface comprises a T-bar which engages the hanger clip though the same opening as the structural wire, wherein rotation of the driveshaft imparts rotation to the hanger clip which further imparts rotation to the structural wire, wherein the transverse tail is drawn toward and wrapped around the shaft to form an eyelet in which the hanger clip is secured.

14. The system of claim 13, further comprising wire support brace for supporting the shaft of the structural wire in substantial alignment with an axis of rotation of the drive rotor during rotation of the shaft.

15. A system for preparing a pre-assembled hanger support, comprising:

a bending tool further comprising;

a combination die further comprising;

a bight die with a bulbous end extending forward from a crosspiece for forming a substantially U-shaped bight in an end of a structural wire; and a tail die extending upward from a central portion of the combination die for forming a partial reverse bend extending away from a shaft of the structural wire and terminating in a free end of the structural wire;

a hinge plate further comprising;

a die press extending perpendicular from the hinge plate;

a hinge located forward from the bight die; and wherein the hinge plate rotates on the hinge causing structural wire to bend about the bight die and subsequently engage an end portion of the structural wire between the die press and the combination die at a point between the bight die and the tail die thus creating a bight in a distal end of the structural wire and a transverse tail wherein the transverse tail extends substantially perpendicularly away from the shaft of the structural wire; and a wrapping tool further comprising;

a wire support brace that supports the shaft of the structural wire;

a tail stop positioned to restrain rotation of the transverse tail;

wherein the structural wire extends through an opening of the hanger clip and the hanger clip is supported within the bight of the structural wire; and a drive rotor having a clip attachment interface that removably supports a hanger clip, wherein the clip attachment interface includes a T-bar configured to extend through the same opening of the hanger clip through which the structural wire also extends, wherein rotation of the drive rotor rotates the hanger clip and thereby the shaft of the structural wire while maintaining co-axial alignment, thereby causing the restrained transverse tail to wrap around the shaft and secure the hanger clip within an eyelet formed in the structural wire to form a pre-assembled hanger support.

16. The system for preparing a pre-assembled hanger support of claim 15, wherein the tail stop comprises a plate having a planar contact face aligned such that the plane of the planar contact face is aligned tangentially at a distance substantially 1.5 times the diameter of the structural wire.

* * * * *